United States Patent [19]

Oswald

[11] 4,395,950

[45] Aug. 2, 1983

[54] ELECTRONIC DELAY BLASTING CIRCUIT

[75] Inventor: Gerald L. Oswald, New Ringgold, Pa.

[73] Assignee: Atlas Powder Company, Dallas, Tex.

[21] Appl. No.: 346,604

[22] Filed: Feb. 8, 1982

Related U.S. Application Data

[62] Division of Ser. No. 146,192, May 5, 1980, Pat. No. 4,328,751.

[51] Int. Cl.[3] ..... F42C 11/06

[52] U.S. Cl. ..... 102/200

[58] Field of Search ..... 102/200, 206, 217, 218, 102/219, 220; 361/251

[56] References Cited

U.S. PATENT DOCUMENTS

| | | | |
|---|---|---|---|
| 3,306,208 | 2/1967 | Bergey et al. | 102/217 |
| 3,343,493 | 9/1967 | Aulds et al. | 102/220 |
| 3,424,924 | 1/1969 | Leisinger et al. | 102/217 |
| 3,610,153 | 10/1971 | Betts et al. | 102/220 |
| 3,618,519 | 11/1971 | Griffith | 102/217 |
| 3,640,224 | 2/1972 | Petrick et al. | 102/220 |
| 4,145,970 | 3/1979 | Hedberg et al. | 102/218 |
| 4,227,461 | 10/1980 | Beezley et al. | 102/218 |
| 4,296,688 | 10/1981 | Orlandi | 102/218 |
| 4,311,096 | 1/1982 | Oswald | 102/220 |

*Primary Examiner*—Charles T. Jordan

*Attorney, Agent, or Firm*—Richards, Harris & Medlock

[57] ABSTRACT

An electronic delay blasting cap (10) receives an input signal over leg wires (12, 14). The input signal is passed through a rectifier (16) to produce a D.C. signal on output lines (26, 28). The D.C. signal charges a storage capacitor (32). When the input signal is removed or the wires (12, 14) are opened or shorted, the charge storage capacitor (32) discharges through a resistor (36) to produce a voltage which charges a timing capacitor (38). When the voltage on capacitor (38) reaches the threshold voltage of a zener diode (48) the diode is rendered conductive which in turn activates an SCR (46). A resistive ignition element (44) is connected in series with the SCR (46) and the charge storage capacitor (32) and is ignited when the SCR (46) is turned on. The charge stored in capacitor (32) causes ignition of the ignition element (44).

7 Claims, 2 Drawing Figures

ELECTRONIC DELAY BLASTING CIRCUIT

This is a division of application Ser. No. 146,192 filed May 5, 1980, now U.S. Pat. No. 4,328,751.

TECHNICAL FIELD

The present invention pertains in general to an electronic circuit and more particularly to such a circuit for firing a blasting cap following a preset delay.

BACKGROUND ART

In most blasting operations, efficient use of explosive energy includes obtaining the desired breakage and movement of ore and rock. It is also becoming increasingly important to minimize the effects of blasting on nearby structures by maintaining close control over ground vibrations produced by the blast. In a multi-hole blasting pattern, it is usually desirable not to have all of the explosives detonate at one time, but to separate the detonation of each hole by at least eight milliseconds in time to control ground vibrations. The separation of the total weight of explosives used in a blast into smaller charges detonated individually in time sequence is achieved by means of delay blasting. Delay blasting normally involves the use of electric or nonelectric delay blasting caps, detonating cord delay connectors or blasting machines of the sequential type.

All presently manufactured electric and nonelectric delay blasting caps have internal delay elements which are based upon the timed burning of pyrotechnic mixtures compressed into metal tubes. The delay timing is achieved by the ignition and burning of the pyrotechnic mixture.

The problem with pyrotechnic delay blasting caps is that, even under the most careful manufacturing conditions, the delay timing of any given delay period is subject to inherent time scatter due to the nature of the burning process. Therefore, the exact detonation time of the blasting cap cannot be controlled with high precision. Because of time scatter, it is possible for pyrotechnic delay blasting caps of two adjoining delay periods to detonate so close together in time that an undesirable level of ground vibration is produced since more than the optimum weight of explosives is detonated at the same time.

The sequential type blasting machine provide controlled timing electric pulses to electric blasting caps. These timing pulses are formed by electronic means and are precise. However, during blasting, circuit wires between the blasting machine and the electric blasting caps must be maintained intact until the blasting caps receive the firing pulses from the machine. Therefore, it has been found that sequential switches must be used in conjunction with pyrotechnic delay electric blasting caps placed in the boreholes to minimize the premature breaking or shorting of circuit wires. Problems with control of vibrations therefore are the same as with the aforementioned use of pyrotechnic delay electric blasting caps.

Unless the sequential blast is designed to have all caps ignited before the first hole detonates, the possibility for broken or shorted circuit wires is increased. Many sequential blasting patterns do not permit all caps to be ignited before hole detonation begins.

In many cases, sequential blasting machine patterns are designed so that there are only eight milliseconds between detonations. It can be seen that the normal scatter in pyrotechnical delays will result in detonations at less than eight millisecond intervals and will increase the probability of out of sequence detonations. When this occurs, ground vibrations may be increased and rock fragmentation may be poor.

Because pyrotechnic delay blasting caps must be used with sequential blasting machines, problems with vibration control and rock fragmentations are the same as with the aforementioned use of delay electric blasting caps.

As explained previously, standard delay blasting involves detonating individual explosive columns at predetermined time intervals. During this process, boreholes that detonate at later delay intervals are subjected to shock and gas pressures generated from the detonation of explosives in adjoining boreholes. Blasting caps are required to withstand these pressures and must function properly at the desired delay interval.

The component parts of an electric blasting system include the blasting machine, firing line, connecting wires, and electric blasting caps.

Electric blasting caps are commonly fired from capacitor discharge type blasting machines. These power sources utilize an energy storage capacitor that is charged to a high voltage such as 450 VDC. Upon activation of a firing switch, the energy is released to the blasting caps through a firing line and connecting wires. Low resistances, heavy gauge copper firing lines and connecting wires are commonly used to minimize energy losses.

Blasting circuits are laid out in series, parallel, or parallel series combinations to permit efficient use of available electrical energy. To assure that the energy is distributed properly, blasting personnel are required to optimize the blasting circuit design by performing energy calculations, which often become difficult and complex. The resistance balancing of parallel branches is also necessary for optimum energy distribution. In the event that the available energy is not distributed properly, and a blasting cap fails to fire because of insufficient current, undetonated explosives will remain in the muckpile resulting in a very hazardous condition.

Many mining and construction companies have difficulty in hiring qualified blasters, and in many cases the turnover of personnel is very high. The frequent training of new blasters, although very important, becomes very costly and time consuming. Therefore, simplification of electric blasting would be advantageous from both a training and the aforementioned safety standpoints.

The high voltage from a standard blasting machine poses either a possible shock hazard condition to blasting personnel or a problem of current leakage from damaged insulation or bare wire connections. A lower voltage electric blasting system would not present a shock hazard, and would be far less susceptible to current leakage, thus, reducing the possibility of misfires.

Electric blasting caps can be fired from a $1\frac{1}{2}$ volt flashlight cell. It would be desirable to increase this voltage requirment to reduce the susceptibility of the cap to be prematurely initiated by extraneous electricity.

In summary, the need for precise delay timing can be clearly justified by improving rock fragmentation and reducing undesirable levels of ground vibration. Also, improving the safety of electric blasting systems is a continuing goal for companies associated with explosives. Reliability, susceptibility to extraneous electricity and simplification of firing systems are all vital areas for safety improvement considerations.

DISCLOSURE OF THE INVENTION

The present invention is a circuit for firing a resistive ignition element following a delay period. The circuit comprises means for full-wave rectifying an input signal to produce a DC signal, means connected to receive the DC signal for storing an electrical charge, means responsive to an amplitude transition of the input signal for producing a timing signal which has a changing voltage, means for detecting when the timing signal is equal to a reference voltage and means for transferring at least a part of the stored electrical charge to the resistive ignition element for ignition thereof when the means for detecting detects that the timing signal is equal to the reference voltage.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1:
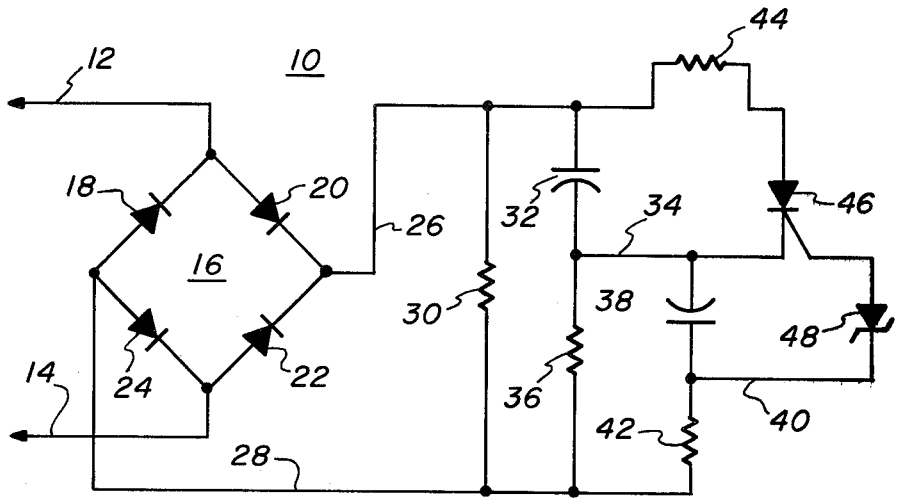
FIG. 1 is a schematic diagram illustrating a delay blasting circuit in accordance with the present invention.

In the following descriptive material, like reference numerals refer to like components in the various views.

Referring to FIG. 1, an electronic delay blasting circuit 10 is connected to receive an input charging signal through leg wires 12 and 14. The input charging signal is preferably a DC signal at 12, 24, or 48 volts. The input charging signal can, however, be AC. The leg wires 12 and 14 are connected to the input terminals of a full-wave rectifier 16. Rectifier 16 is a diode bridge comprising diodes 18, 20, 22 and 24. The output terminals of rectifier 16 are connected to lines 26 and 28.

A resistor 30 has a first terminal thereof connected to line 26 and a second terminal thereof connected to line 28.

A capacitor 32 is connected between line 26 and a node 34. A resistor 36 is connected between node 34 and line 28. Resistor 36 is connected in series with capacitor 32 between lines 26 and 28.

A capacitor 38 is connected between node 34 and a second node 40. A resistor 42 is connected between node 40 and line 28. Resistor 42 is connected in series with capacitor 38 between node 34 and line 28.

A resistive ignition element 44, such as a resistance wire, has a first terminal thereof connected to line 26 and a second terminal thereof connected to the anode terminal of a silicon controlled rectifier (SCR) 46. The cathode terminal of SCR 46 is connected to node 34. The gate terminal of SCR 46 is connected to the anode terminal of a zener diode 48. The cathode terminal of zener diode 48 is connected to node 40.

The operation of electronic delay blasting circuit 10 is now described in reference to FIG. 1. Circuit 10 is fabricated to be an integral part of a blasting cap (not shown) which serves to ignite a primary charge. As noted above, heavy gauge wire and a high energy power source have heretofore been required for the activation of a plurality of electric blasting caps. The circuit of the present invention, however, permits the firing of a plurality of blasting caps and requires only a small gauge firing line and a low energy power source.

The input signal, either A.C. or D.C., to circuit 10 is provided through leg wires 12 and 14 to the fullwave rectifier 16. The output of rectifier 16 is a D.C. signal between lines 26 and 28 in which line 26 is the more positive relative to line 28.

The D.C. signal produced by rectifier 16 is applied directly to resistor 30 and to capacitor 32 through resistor 36. Capacitor 32 is charged by the D.C. signal and the rate of charge is dependent upon its capacitance, the resistance of resistor 36, the impedance of diodes 18–24 and the internal resistance of the energy source (not shown) which supplies the input signal to the leg wires 12 and 14. After a period of time, capacitor 32 will become charged to the peak level of the D.C. voltage produced by rectifier 16.

During the charging of capacitor 32, a current will flow through resistor 36 which will produce a voltage across the series combination of resistor 42 and capacitor 38. This will produce a temporary charge on capacitor 38 which will tend to apply a negative bias to the gate terminal of SCR 46. Since SCR 46 is in the off state at this time the voltage across capacitor 38 has no effect on SCR 46 during the charging of capacitor 32. After capacitor 32 as reached its full charge, capacitor 38 will discharge through resistors 36 and 42.

After capacitor 32 has reached a full charge provided by the D.C. signal produced by rectifier 16, circuit 10 will be in the quiescent state. Current will continue to flow through resistor 30 but the current flow through the remainder of the circuit will be minute. When the capacitor 32 is charged to approximately the peak value of the input signal provided on lines 12 and 14, circuit 10 is armed and in the ready to fire condition.

Upon removal of the input signal from lines 12 and 14, which constitutes a sudden transition reducing the amplitude of the input signal, the delay elements of circuit 10 are activated. Storage capacitor 32 now becomes the source of energy for circuit 10. Current flow is established through resistors 30 and 36 which produces a voltage differential across resistor 36 that in turn produces a current flow through the series combination of resistor 42 and capacitor 38. For a period of time the voltage across capacitor 38 will increase continuously until the voltage on the capacitor is equal to the threshold, reference, voltage of zener diode 48. When the voltage on capacitor 38 reaches this threshold voltage, zener diode 48 will be reversed biased and a positive voltage will be applied to the gate terminal of SCR 46. The positive potential on the gate terminal causes SCR 46 to become conductive which in turn connects the resistive ignition element 44 directly across the terminals of capacitor 32. A substantial portion of the remaining charge on capacitor 32 is applied to element 44 and is sufficient to cause the element to ignite. This in turn causes detonation of the blasting cap containing circuit 10.

The time delay between the removal of the input signal and the firing of element 44 is determined by resistors 30, 36 and 42 together with the capacitance of capacitors 32 and 38. The most direct method, however, for setting the time delay of circuit 10 is to adjust the values of resistor 42 and capacitor 38.

An important aspect of the electronic delay blasting cap is that once the unit is armed by an input signal, the circuit will function normally even if the external firing line or leg wires become broken or short circuited during the blast. The rectifier 16 is used to isolate the armed circuit from the external circuit to prevent the external circuit from affecting the timing operation and to prevent the stored energy from bleeding back into the input wires. The rectifier 16 also permits firing line connections to be made without regard to polarity. Also, the reliability of the blasting operation is substantially increased by storing electrical energy in a capacitor which is a component part of each electronic delay blasting cap. This permits all of the caps in a blasting pattern to be armed and self-operating before the first hole detonates. Therefore, the problems associated with breaking or shorting of circuit wires, due to burden or surface movement in a blast, are eliminated.

In addition, the delay time of an electronic delay blasting cap as described herein is extremely accurate and precise when compared to conventional delay blasting caps using pyrotechnic mixtures for delay timing.

A design example for the circuit shown in FIG. 1 is provided with the values shown in Table 1.

TABLE I

| | |
|---|---|
| Input Signal = | 24 Volts D.C. |
| Resistor 30 = | 2K Ohms, ⅛ Watt |
| Resistor 36 = | 10K Ohms, ⅛ Watt |
| Resistor 42 = | 100K Ohms, ⅛ Watt |
| Capacitor 32 = | 100 Microfarads, 25 V.D.C. |
| Capacitor 38 = | 1 Microfarad, 12 V.D.C. |
| Zener Diode 48 = | 12 Volts, ½ Watt - Sylvania ECG-5021 |
| SCR 46 = | 0.8 Amps - Sylvania ECG-5400 |
| Ignition Element 44 = | Instantaneous Electric Blasting Cap |
| Delay Period = | 141 Milliseconds (±1 Millisecond) |

A plurality of electronic blasting caps utilizing the circuit shown in FIG. 1 have been tested when connected in straight parallel. The blasting caps were activated successfully with approximately the same delay time.

Figure 2:
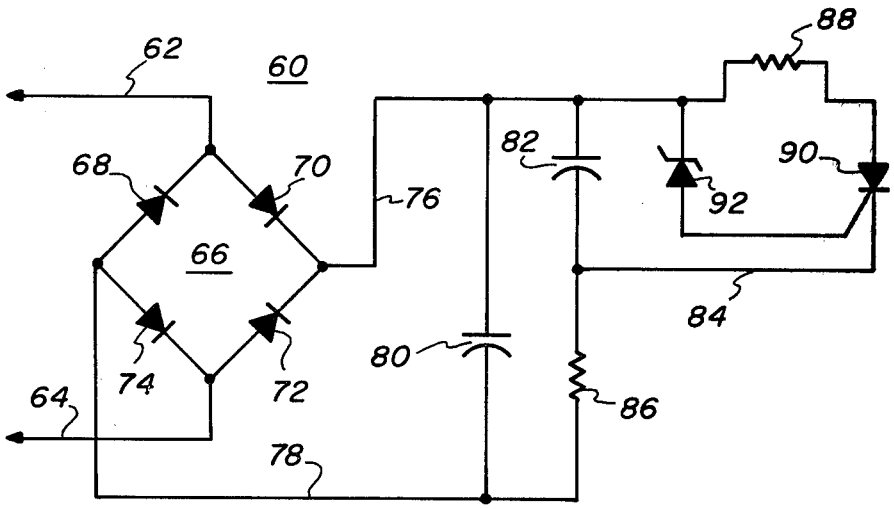
FIG. 2 is a schematic diagram illustrating a alternative embodiment of a delay blasting circuit in accordance with the present invention.

A further embodiment of the present invention is illustrated in FIG. 2. Electronic delay blasting circuit 60, which is fabricated to be an integral part of a blasting cap, receives an input signal over leg wires 62 and 64 which are connected to the input terminals of a full-wave rectifier 66. A plurality of diodes 68, 70, 72 and 74 are connected in a bridge arrangement to form rectifier 66. The output terminals of rectifier 66 are connected to lines 76 and 78. Rectifier produces a D.C. signal output on lines 76 and 78 with line 76 positive relative to line 78.

An energy storage capacitor 80 has a first terminal thereof connected to line 76 and a second terminal thereof connected to line 78.

A capacitor 82 has a first terminal connected to line 76 and a second terminal connected to a node 84. A resistor 86 is connected between node 84 and line 78.

A resistive ignition element 88 has a first terminal connected to line 76 and a second terminal connected to the anode terminal of an SCR 90. The cathode terminal of SCR 90 is connected to node 84.

A zener diode 92 has the anode terminal thereof connected to the gate terminal of SCR 90 and the cathode terminal thereof connected to line 76.

The electronic firing circuit 60 functions in a different manner from that of circuit 10 shown in FIG. 1. The time delay period of circuit 60 begins upon the application of the input signal. When the input signal transitions from a zero level to its full potential a current pulse is applied through leg wires 62 and 64 to the rectifier 66. This current pulse produces a D.C. signal at the output of rectifier 66 between lines 76 and 78. The D.C. signal resulting from the current pulse starts to immediately charge capacitor 80 while charging capacitor 82 through resistor 86. After the initial transition of the input pulse the voltage on capacitor 82 will continuously increase until it reaches the threshold voltage of zener diode 92. When the threshold is reached the zener diode 92 will become conductive and the gate terminal of SCR 90 will have a positive voltage applied thereto. A positive voltage on the gate terminal of SCR 90 causes the SCR to become conductive and connect the ignition element 88 directly between line 76 and node 84. The energy stored on capacitors 80 and 82 will then be directed through the ignition element 88 to cause ignition thereof.

The time delay of circuit 60 is controlled by the charging of capacitor 82 and this is primarily determined by the resistance value of resistor 86.

The use of circuit 60 in place of circuit 10 provides an advantage in the case where an open or short could occur in the firing circuit before the storage capacitor in circuit 10 is fully charged. When this occurs the time delay for the blast does not occur on schedule. But with the circuit 60 the time period is initiated at the start of the input signal. The circuit 60, however, requires the use of heavy gauge, low resistance firing line and a high energy firing source in order to fire a substantial number of caps in a single blast.

A further advantage of circuit 60 is that it utilizes fewer components than circuit 10. By having fewer components circuit 60 is less expensive and is also more reliable since there are fewer circuit elements subject to failure.

The circuits of the present invention offer numerous advantages including:

(a) the accuracy and precision of the timing of the electronic delay blasting cap is far superior to presently available pyrotechnic delays, (b) the use of electronic delay blasting caps enables much better control over ground vibrations produced in multiple charge blasting operations by accurately controlling the time intervals between detonations, (c) the use of electronic delay blasting caps gives blasting operators greater flexibility by permitting the use of more individual charges. This can be accomplished because the detonation can be controlled with greater precision and accuracy, thereby presenting the possibility of reducing the time intervals between detonations, (d) the use of electronic delay blasting caps improves blasting results by eliminating out-of-sequence detonations, (e) the combination of the electronic delay blasting cap and the sequential switch gives a more complete blast initiation system to delay times controlled completely by electronic means rather than by a combination of electronic (sequential switch) and pyrotechnic means, The electronic delay blasting circuits of the present invention provide more reliability in blasting operations for the following reasons:

(a) all of the caps are armed prior to the detonation of any blast hole, (b) the caps can be activated from a low voltage power source, thereby eliminating the shock hazard to blasting personnel and reducing the possibility of current leakage.

(c) all of the caps are connected in parallel whch eliminates the need for energy calculations, thus, providing a blasting system that is more simple than conventional electric blasting systems.

The electronic delay blasting circuits of the present invention also provides a greater safety margin over conventional electric blasting caps for the following reasons:

(a) the blasting circuits of the present invention require higher voltage levels for initiation, (b) the resistance to static electricity is improved with the control circuit components, (c) the need for energy calculations is eliminated thus reducing the possibility of misfires.

A further advantage of the circuits of the present invention is that the time delay for the electronic delay blasting cap can be measured accurately during production to allow stamping of the actual delay time on the cap prior to field use. This assures that a correct time delay cap is used in a given operation.

Although several embodiment of the invention have been illustrated in the accompanying drawings and described in the foregoing detailed description, it will be understood that the invention is not limited to the embodiments disclosed, but is capable of numerous rearrangements, modifications and substitutions without departing from the scope of the invention.

I claim:

1. A method for firing a resistive ignition element following a delay period, comprising:

full-wave rectifying an input signal to produce a D.C. signal, storing an electrical charge produced by said D.C. signal, generating a timing signal having a changing voltage after an amplitude transition of said input signal, detecting when said timing signal is equal to a reference voltage, transferring at least a part of said stored electrical charge to said resistive ignition element for ignition thereof when said timing signal is detected to be equal to said reference voltage.

2. The method recited in claim 1 wherein the step of full-wave rectifying comprises passing said input signal through a four diode bridge rectifier.

3. The method recited in claim 1 wherein the step of storing an electrical charge comprises charging a capacitor with said D.C. signal.

4. The method recited in claim 1 wherein the step of generating a timing signal comprises charging a capacitor with current received from said electrical charge.

5. The method recited in claim 1 wherein the step of generating a timing signal comprises charging a capacitor with said D.C. signal.

6. The method recited in claim 1 wherein the step of detecting comprises applying said timing signal to a zener diode.

7. The method recited in claim 1 wherein the step of transferring comprises firing a silicon controlled rectifier which is connected in series with said electrical charge and said resistive ignition element.

* * * * *